US009700092B2

(12) United States Patent
Alex

(10) Patent No.: US 9,700,092 B2
(45) Date of Patent: Jul. 11, 2017

(54) HAIR PIECE WITH INTEGRATED SECURING MECHANISM

(71) Applicant: Guenter Alex, Erlangen (DE)

(72) Inventor: Guenter Alex, Erlangen (DE)

(73) Assignee: HAIRTALK GMBH, Erlangen (DE)

( * ) Notice: Subject to any disclaimer, the term of this patent is extended or adjusted under 35 U.S.C. 154(b) by 0 days.

(21) Appl. No.: 13/622,115

(22) Filed: Sep. 18, 2012

(65) Prior Publication Data

US 2013/0048002 A1 Feb. 28, 2013

Related U.S. Application Data

(63) Continuation of application No. PCT/EP2010/067678, filed on Nov. 17, 2010.

(30) Foreign Application Priority Data

Mar. 31, 2010 (DE) ..... 20 2010 000 513 U

(51) Int. Cl.
*A41G 5/00* (2006.01)
*A41G 3/00* (2006.01)

(52) U.S. Cl.
CPC ..... *A41G 5/0033* (2013.01); *A41G 3/0008* (2013.01); *A41G 3/0025* (2013.01);
(Continued)

(58) Field of Classification Search
CPC ..... A41G 3/00; A41G 3/008; A41G 3/0025; A41G 5/0013; A41G 5/002; A41G 5/0033;
(Continued)

(56) References Cited

U.S. PATENT DOCUMENTS 4,799,502 A * 1/1989 Kobayashi et al. ..... 132/53
5,117,846 A * 6/1992 Finamore et al. ..... 132/54
(Continued)

FOREIGN PATENT DOCUMENTS

EP 0 997 079 B1 1/2005
GB 2 456 655 A 7/2009
(Continued)

OTHER PUBLICATIONS

International Search Report in co-pending, related PCT Application No. PCT/EP2010/067678, mailed Aug. 8, 2011.

*Primary Examiner* — Tatiana Nobrega
(74) *Attorney, Agent, or Firm* — Thomas | Horstemeyer, LLP

(57) ABSTRACT

A hair piece (1) comprises a foundation (3) having a boundary area (4) extending along a circumference (7); hairs (2) attached to the foundation; and at least one securing mechanism for securing the hair piece to natural hairs of its bearer. The securing mechanism comprises at least one slot (6) in the boundary area, which extends along the circumference and ends in the boundary area in both directions. An adhesive surface (8) extends from the slot towards the circumference. Hairs are attached to the foundation next to the adhesive surface in both directions of the circumference. A section (10) of self-adhesive hair band has an adhesive back to be glued to hairs of the bearer pulled through the slot and pressed against the adhesive surface. This section of self-adhesive hair band is permanently connected to the boundary area at that side of the slot opposite to the adhesive surface.

9 Claims, 3 Drawing Sheets

(52) U.S. Cl.
CPC ..... *A41G 5/002* (2013.01); *A41G 5/008* (2013.01); *A41G 5/0053* (2013.01)

(58) Field of Classification Search
CPC ..... A41G 5/0053; A41G 5/006; A41G 5/008; A45G 5/0013; A45G 5/002; A45G 5/0033; A45G 5/0053; A45G 5/006; A45G 5/008
USPC ..... 132/53, 54
See application file for complete search history.

(56) References Cited

U.S. PATENT DOCUMENTS

| | | | | | |
|---|---|---|---|---|---|
| 5,218,977 | A * | 6/1993 | Takahashi | ..... | 132/54 |
| 5,855,211 | A * | 1/1999 | Nelson | ..... | 132/53 |
| 5,992,424 | A * | 11/1999 | Repsha et al. | ..... | 132/201 |
| 6,012,460 | A * | 1/2000 | Kikuchi | ..... | 132/53 |
| 6,105,584 | A * | 8/2000 | Williams | ..... | 132/53 |
| 6,170,491 | B1 * | 1/2001 | Maekawa | ..... | 132/201 |
| 6,267,118 | B1 * | 7/2001 | Ito et al. | ..... | 132/201 |
| 7,861,729 | B2 * | 1/2011 | Zephyr et al. | ..... | 132/53 |
| 8,141,560 | B2 * | 3/2012 | Toba | ..... | 132/201 |
| 2005/0051186 | A1 * | 3/2005 | Smith et al. | ..... | 132/54 |
| 2005/0252518 | A1 * | 11/2005 | Salinas | ..... | 132/201 |
| 2008/0295856 | A1 * | 12/2008 | Kallabat et al. | ..... | 132/201 |
| 2009/0235943 | A1 * | 9/2009 | Sugai et al. | ..... | 132/54 |
| 2010/0170527 | A1 | 7/2010 | Toba | | |

FOREIGN PATENT DOCUMENTS

| | | | | | |
|---|---|---|---|---|---|
| WO | 2008/000363 | A1 | 1/2008 | | |
| WO | WO 2008/000363 | * | 1/2008 | ..... | A41G 5/00 |

* cited by examiner

HAIR PIECE WITH INTEGRATED SECURING MECHANISM

CROSS REFERENCE TO RELATED APPLICATIONS

This application is a continuation of International Application PCT/EP2010/067678 with an International Filing Date of Nov. 17, 2010 and claiming priority to German Utility Model Application No. 20 2010 000 513.2 entitled "Haarersatz mit integrierter Sicherungseinrichtung", filed on Mar. 31, 2010, now registered.

FIELD OF THE INVENTION

The invention relates to a hair piece comprising a foundation, hairs attached to the foundation, and at least one securing mechanism for securing the hair piece to the natural hairs of a bearer. Particularly, the hair piece is a two-dimensional hair piece, which may also be designated as a toupee.

BACKGROUND OF THE INVENTION

A hair piece comprising a foundation, hairs attached to the foundation and at least one securing mechanism for securing the hair piece to the natural hairs of a bearer is known from European Patent Application Publication EP 0 997 079 A1. Here, the securing mechanism consists of two-part securing elements. One of these two parts of each securing element is adhesive at both faces, and, with its outer face, stuck from beneath on the boundary area of the foundation. The other part which is hinged to the one part comprises several slots for pulling through natural hairs of the bearer of the hair piece, which are glued between both parts of the securing element beneath the foundation to secure the hair piece. The multi-layer construction of this known hair piece in the area of its securing elements proves to be disadvantageous because of its thickness.

Another hair piece comprising a foundation, hairs attached to the foundation and at least one securing mechanism for securing the hair piece to the natural hairs of a bearer is known from International Patent Application Publication WO 2008/000363 A1. Here, the securing mechanism is integrated in the boundary area of the foundation which allows for a flat construction and a non-obvious application of the hair piece. To the end of securing this known hair piece, several sections of hair band, which are separate parts here, are to be glued on one of several adhesive areas in a correct allocation.

There still is a need of a hair piece which retains the advantages of the hair piece known from WO 2008/000363 A1, but which may be attached to the natural hair of its bearer even more easily.

SUMMARY OF THE INVENTION

The present invention generally relates to a hair piece comprising a foundation having a circumference and a boundary area extending along the circumference; hairs attached to the foundation; and at least one securing mechanism for securing the hair piece to natural hairs of its bearer. The at least one securing mechanism comprises at least one slot in the boundary area of the foundation, which extends over a distance along the circumference of the foundation and ends in boundary area of the foundation in both directions; an adhesive surface extending from the at least one slot towards the circumference of the foundation, hairs being attached to the foundation next to the adhesive surface in both directions of the circumference; and a section of self-adhesive hair band having an adhesive back configured to be glued to hairs of the bearer pulled through the slot and pressed against the adhesive surface. The section of self-adhesive hair band is permanently connected to the boundary area of the foundation at that side of the slot opposite to the adhesive surface.

In a more detailed aspect, the present invention relates to a hair piece comprising a foundation having a circumference, a boundary area extending along the circumference, which is reinforced by a flat plastic material, and a net with hairs attached; and a plurality of securing mechanisms arranged along the circumference of the foundation for securing the hair piece to natural hairs of its bearer. Each securing mechanism comprises at least one slot in the boundary area of the foundation, which extends over a distance along the circumference of the foundation through the plastic material and ends in the plastic material at both ends; two cuts in the net of the foundation, each beginning at the circumference of the foundation and extending towards one of the ends of the at least one slot, the flat plastic material reinforcing the boundary of the foundation remaining uncut; an adhesive surface prepared on the flat plastic material in an area between the cuts, and extending laterally from the at least one slot towards the circumference of the net foundation, parts of the net with the hairs being fixed to the flat plastic material next to the adhesive surface in both directions of the circumference; and a section of the net with hairs, which extends between the two cuts and which is permanently connected to the boundary area of the foundation at that side of the slot opposite to the adhesive surface, being provided with an adhesive back opposing the adhesive surface.

Other features and advantages of the present invention will become apparent to one with skill in the art upon examination of the following drawings and the detailed description. It is intended that all such additional features and advantages be included herein within the scope of the present invention, as defined by the claims.

BRIEF DESCRIPTION OF THE DRAWINGS

The invention can be better understood with reference to the following drawings. The components in the drawings are not necessarily to scale, emphasis instead being placed upon clearly illustrating the principles of the present invention. In the drawings, like reference numerals designate corresponding parts throughout the several views.

DETAILED DESCRIPTION

Figure 1:
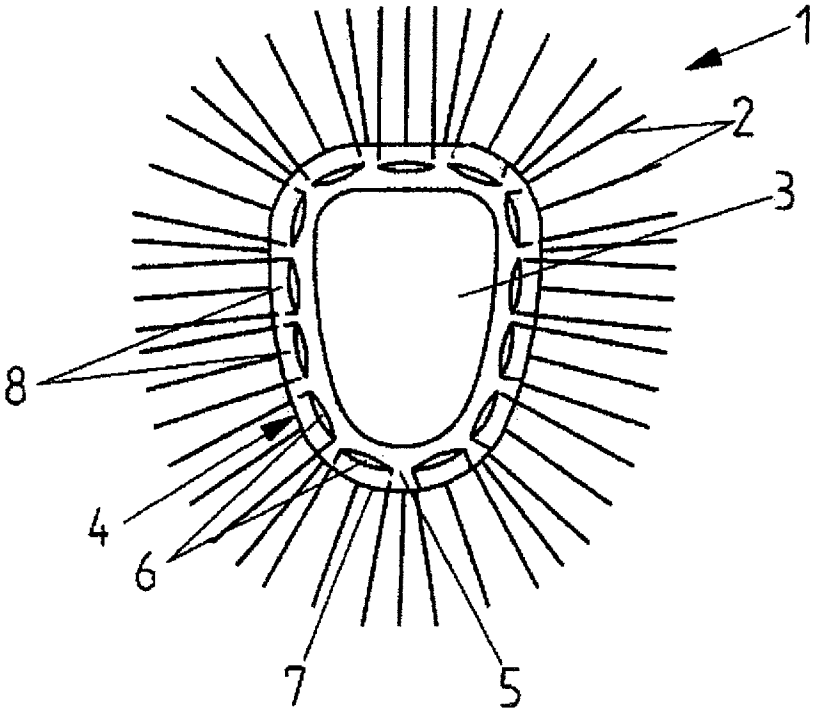
FIG. 1 is a sketch of a new hair piece in a view from beneath.

In the new hair piece, the hair band, which is to be glued to the hairs of the bearer pulled through the slot and pressed against the adhesive surface, is permanently attached to the foundation in the boundary area of the foundation at that side of the slot opposing the adhesive surface. Thus, there is an unambiguous allocation of the hair band to the adhesive surface. Mixing up different sections of hair band which are belonging to the adhesive surfaces in different positions in the boundary area of the foundation is thus avoided. Additionally, the section of the hair band is automatically correctly positioned with regard to the adhesive surface so that securing the new hair piece may easily be accomplished by a single person, i.e. without the help of an auxiliary person.

Particularly, a net foundation provided with hairs may be provided in the new hair piece, which is cut from the circumference of the foundation next to the adhesive surface in both directions of the circumference of the foundation, the self-adhesive hair band being made of the section of the net foundation between the two cuts. Thus, all hairs of the new hair piece may be provided by a single net foundation provided with hairs, actually inclusive of the hairs of each section of hair band. This also means that no area of the net foundation is to be removed above the adhesive surfaces and to be possibly discarded. Instead, these sections of the net foundation arranged above the adhesive surfaces are each particularly used to make one section of the hair band to be glued to the respective adhesive surface.

The net foundation may be reinforced in the closed loop boundary area of the foundation. This may be achieved in that a flat material is glued under the net foundation in the closed loop boundary area, the gluing not including the sections of the net foundation between its cuts next to the adhesive surfaces. Instead, beneath these sections, the adhesive surfaces of the hair piece are formed. The adjacent slots in the boundary area of the foundation may also be cut only after gluing the flat material to the boundary area of the net foundation.

As already mentioned and as a rule, several slots, adhesive surfaces and associated sections of hair band are arranged along the circumference of the foundation in the new hair piece. These slots, adhesive surfaces and sections of hair band are preferably uniformly distributed over the circumference of the foundation. Further, it is preferred that the sum of the length of the slots along the circumference is at least as high as half of the circumference of the foundation. For example, the slots may extend over about two thirds of the circumference of the foundation, so that the new hair piece is secured via as much hair of the bearer as possible and as broadly distributed hair of the bearer as possible.

The adhesive surface of the new hair piece is preferably also self-adhesive like the self-adhesive hair band, and it is further preferably also initially covered with a removable protection foil like the self-adhesive hair band. In use of the new hair piece, typically, at first the protection foil covering the adhesive surface is removed to glue the hairs of the bearer of the hair piece pulled through the adjacent slot to the adhesive surface, before the protection layer is also removed from the section of the hair band to glue the hair band to the hairs glued to the adhesive surface.

A high-value hair piece is suitable for a long use, i.e. for several times of securing it to the hairs of its bearer. Thus, it is preferred that the glue layers of the adhesive surface and the self-adhesive hair band are renewable. To this end, they may be made of flat glue strips adhesive at both faces which can be removed with the aid of alcohol or other organic solvents and which can afterwards be replaced by a new flat glue strip.

Referring now in greater detail to the drawings, the hair piece 1 schematically depicted in FIG. 1 from beneath and having a circumference 7 is based on a net foundation 3 provided with hairs 2. In its boundary area 4, the net foundation 3 is reinforced with a flat material 5 which is stuck from beneath on the net foundation 3, and in which slots 6 are provided, which each extend over a distance along the circumference 7. Adjacent to each slot 6 and towards the circumference 7, an adhesive surface 8 is provided on top of the flat material 5, which are not directly visible here. This adhesive surface 8 may be seen in more detail from the further figures. The circumference 7 defines a bottom edge of the boundary area 4, and each slot 6 extends substantially parallel to the circumference 7.

Figure 2:
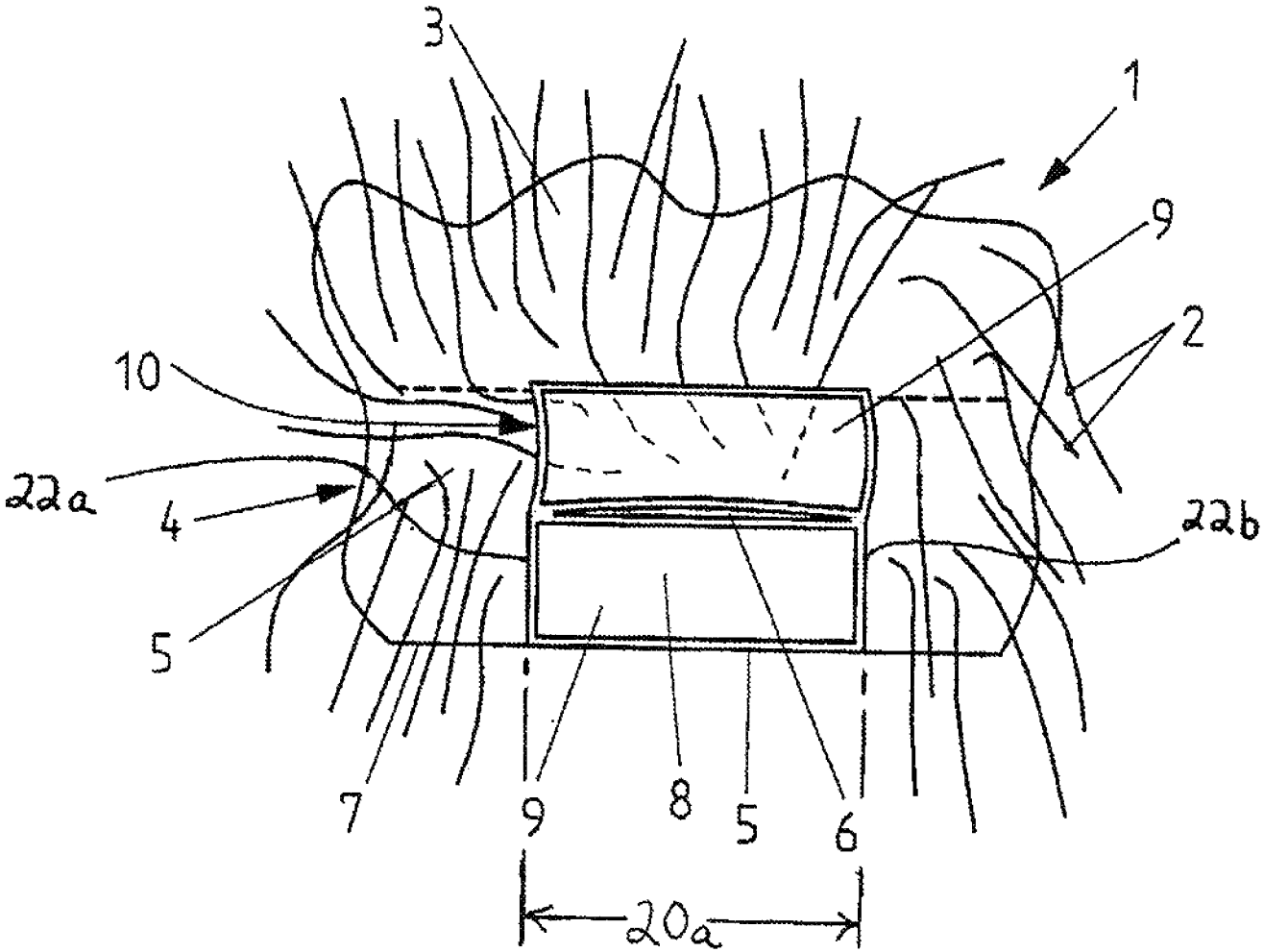
FIG. 2 shows sketches a plane view onto an adhesive surface and an adjacent section of a hair band in the new hair piece.
Figure 3:
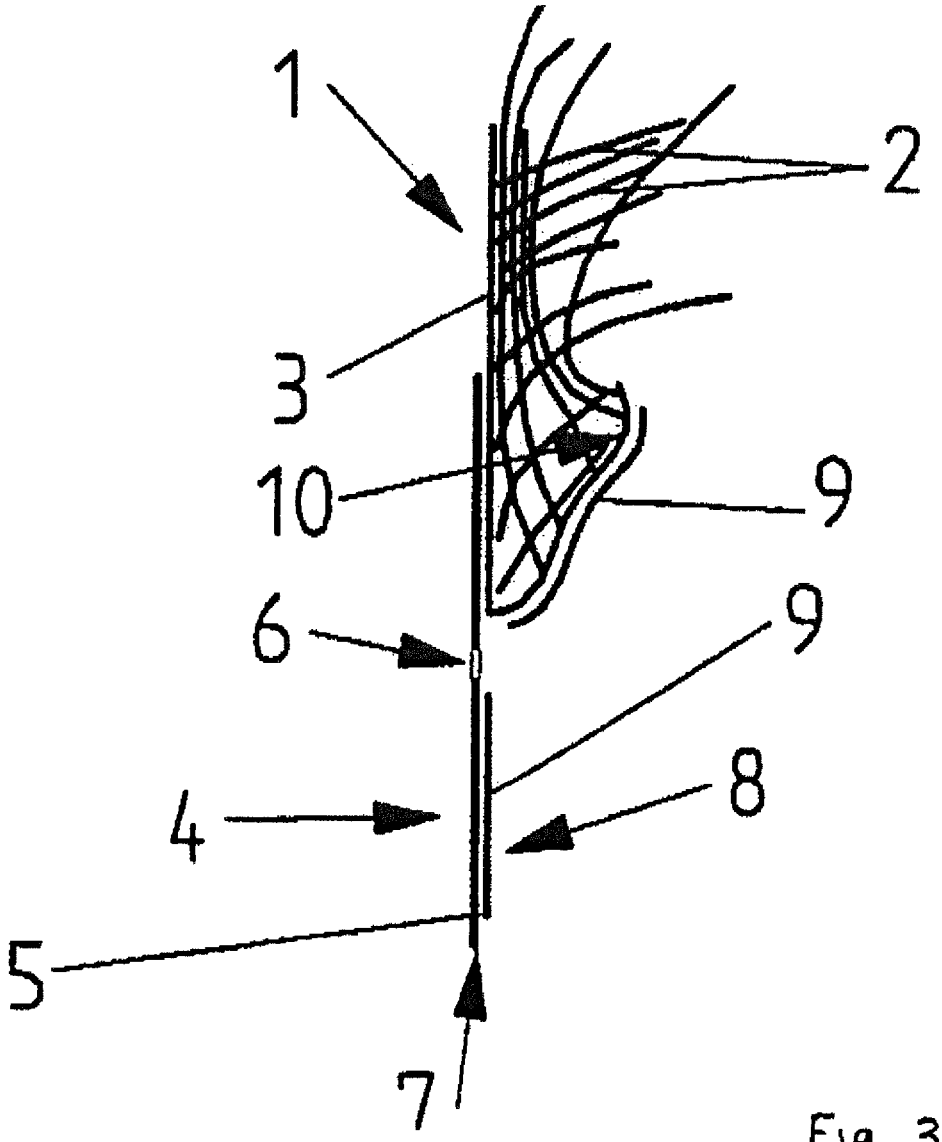
FIG. 3 is a cross-sectional view of the same parts depicted in FIG. 2.

FIGS. 2 and 3 show one of the adhesive surfaces 8. A plurality of adhesive surfaces 8 are shown in boundary area 4 in FIG. 1. These adhesive surfaces 8 are formed by a flat glue strip 9 on the plastic flat material 5 along one of the slots 6. At both ends of the adhesive surface 8, the net foundation 3 is cut so that a flap section 10 of hair band is formed (see FIG. 3, flap 10) which, however, is still connected to the remainder of the net foundation 3 in parallel to the slot 6. At its underside, the flap section 10 is also provided with a flat glue strip 9. Both flat glue strips 9 are at first covered with cover foils (not depicted). As soon as these cover foils are removed, both the flap section 10 and the adhesive surface 8 are self-adhesive. To the end of securing the hair piece 1, the natural hairs of the bearer of the hair piece 1 are pulled through the slot 6 and glued to the adhesive surface 8, after at first removing the respective protection foil. Then the flap section 10, after removing its protection layer, is glued to the hairs already glued to the adhesive surface 8. As shown in FIG. 3, the flap section 10 has hairs thereon. Further, as shown in FIG. 2, the flap section 10 is defined by cuts 22*a*, 22*b* and extends a distance 20*a*.

Many variations and modifications may be made to the preferred embodiments of the invention without departing substantially from the spirit and principles of the invention. All such modifications and variations are intended to be included herein within the scope of the present invention, as defined by the following claims.

I claim:

1. A hair piece comprising:

a net foundation having an inner surface, an outer surface, a circumference and a boundary area extending along said circumference such that said circumference defines a bottom edge of said boundary area and a height of said boundary area is defined between said circumference and a top edge disposed opposite and substantially parallel to said circumference;

hairs attached to said outer surface of said net foundation;

said net foundation being reinforced by a flat plastic material attached along said inner surface of said net foundation along an entirety of said boundary area; and a plurality of securing mechanisms provided in said boundary area for securing the hair piece to natural hairs of its bearer, each of said security mechanisms including:

a slot extending through said flat plastic material and said net foundation such that natural hairs of the bearer are adapted to be pulled through said slot, said slot being spaced between and extending substantially parallel to said circumference and said top edge of said boundary area, said slot having opposing slot ends;

a flap section defined by two parallel cuts in said net foundation, each cut extending transversely from said circumference to a respective one of said slot ends, where an outer surface of said flap section corresponds to said outer surface of said net foundation and an inner surface of said flap section includes an adhesive band, wherein said flap section exposes a portion of said flat plastic material there beneath;

an adhesive surface on said exposed portion of said flat plastic material extending from said slot towards said circumference of said net foundation; and wherein said plurality of securing mechanisms are spaced apart along said boundary area such that between adjacent securing mechanisms are provided sections of said boundary area formed of said net foundation disposed over said flat plastic material, said hairs of said net foundation are provided on said outer surfaces of said flap sections and said sections of net foundation between adjacent securing mechanisms and where the securing mechanisms are configured to secure said hair piece to the bearer's natural hair by pulling sections of the bearer's natural hair through said slots and sandwiching these sections of hair between said adhesive bands of said flap sections and said adhesive surfaces of said exposed portions of flat plastic material.

2. The hair piece of claim 1, wherein said plurality of securing mechanism are uniformly distributed over said boundary area of said foundation.

3. The hair piece of claim 1, wherein a sum of the lengths of said slots of said plurality of securing mechanisms is at least 50% of the length of said circumference of said foundation.

4. The hair piece of claim 1, wherein said adhesive surface and said adhesive band are both provides with removable protection foils.

5. The hair piece of claim 1, wherein a glue layer of said adhesive surface and a glue layer of said adhesive band are exchangeable.

6. The hair piece of claim 5, wherein said glue layers are flat glue strips having adhesive at both faces.

7. A hair piece comprising:

a foundation having an inner surface, an outer surface, a circumference, a boundary area extending along said circumference such that said circumference defines a bottom edge of said boundary area and a height of said boundary area is defined between said circumference and a top edge disposed opposite and substantially parallel to said circumference;

said foundation is reinforced by a flat plastic material, attached along said inner surface of said foundation along an entirety of said boundary area; and hairs attached to said outer surface of said foundation; and a plurality of securing mechanisms provided in said boundary area for securing the hair piece to natural hairs of its bearer, each of said securing mechanisms including:

a slot extending through said flat plastic material and said foundation such that natural hairs of the bearer are adapted to be pulled through said slot, said slot being spaced between and extending substantially parallel to said circumference and said top edge of said boundary area, said slot having opposing slot ends;

a flap section defined by two parallel cuts in said foundation, each cut extending transversely from said circumference to a respective one of said slot ends where an outer surface of said flap section corresponds to said outer surface of said foundation and an inner surface of said flap section includes an adhesive band, wherein said flap section exposes a portion of said flat plastic material there beneath;

an adhesive surface on said exposed portion of said flat plastic material extending from said slot towards said circumference of said foundation; and wherein said plurality of securing mechanisms are spaced apart along said boundary such that between adjacent securing mechanisms are provided sections of said boundary area formed of said foundation disposed over said flat plastic material, said hairs of said foundation are provided on said outer surfaces of said flap sections and said sections of foundation between adjacent securing mechanisms and where the securing mechanisms are configured to secure said hair piece to the bearer's natural hair by pulling sections of the bearer's natural hair through said slots and sandwiching these sections of hair between said adhesive bands of said flap sections and said adhesive surfaces of said exposed portions of flat plastic material.

8. The hair piece of claim 7, wherein said adhesive surface and said adhesive band of said flap section are provided with removable protection foils.

9. The hair piece of claim 7, wherein a glue layer of said adhesive surface and a glue layer of said adhesive band of said flap section are exchangeable.

* * * * *